US005567383A

United States Patent [19]

Noda et al.

[11] Patent Number: 5,567,383

[45] Date of Patent: Oct. 22, 1996

[54] HEAT RESISTING ALLOYS

[75] Inventors: Toshiharu Noda, Tajimi; Katsuaki Sato; Tsutomu Saka, both of Wako, all of Japan

[73] Assignees: Daido Tokushuko Kabushiki Kaisha, Aichi-Prefecture; Honda Giken Kogyo Kabushiki Kaisha, Tokyo, both of Japan

[21] Appl. No.: 471,153

[22] Filed: Jun. 6, 1995

[30] Foreign Application Priority Data

Jun. 15, 1994 [JP] Japan ..... 6-133050

[51] Int. Cl.[6] ..... C22C 30/00

[52] U.S. Cl. ..... 420/584.1; 420/586

[58] Field of Search ..... 420/584.1, 586

[56] References Cited

FOREIGN PATENT DOCUMENTS 183536 6/1986 European Pat. Off. ..... 420/584.1
56-20148 2/1981 Japan .
61-9548 1/1986 Japan .
1-259140 10/1989 Japan .

*Primary Examiner*—Deborah Yee
*Attorney, Agent, or Firm*—Sughrue, Mion, Zinn, Macpeak & Seas

[57] ABSTRACT

A heat resisting alloy for use in exhaust valves and the like low in price and excellent in structural stability, high-temperature strength and hot workability, which consists essentially by weight percentage of C: 0.01~0.10%, Si≦2.0%, Mn≦2.0%, Cr: 14~20%, Nb+Ta: 0.3~1.5%, Ti: 1.5~3.5%, Al: 0.5~1.5%, Ni+Co: 35~45%, B: 0.001~0.01%, one or both of Ca: 0.001~0.03% and Mg: 0,001~0.03%, and the balance of Fe, additionally the total atomic percentage of Al, Ti, Nb, and Ta: 4.5~6.0%, an atomic percentage ratio of Ti/Al: 1.0~2.0, and M-value obtained through the following equation≦0.925;

M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction)+1.001 Mn (atomic fraction)+1.90 Si (atomic fraction)+0.777 Co (atomic fraction)+2.224 Ta (atomic fraction).

16 Claims, No Drawings

HEAT RESISTING ALLOYS

BACKGROUND OF THE INVENTION

1. Field of the Invention

This invention relates to a heat resisting alloy applicable to materials for high-temperature spring and wires for meshes of catalyzer for purifying exhaust gas in addition to materials for exhaust valves of various automobile engines and marine engines.

2 Description of the Prior Art

In recent years, the increase in the number of engine valves (for example, four valves per one cylinder) and the reduction in a diameter of the engine valve are promoted in order to obtain a high power and high rotational engine. Hitherto, high Mn austenitic heat resisting steel SUH 35 (Fe-9Mn-21Cr-4Ni-0.5C-0.4N) has been widely used as an exhaust valve material for gasoline engines, however as a high-strength exhaust valve material for high power engine used at 800° C. or above, Ni-based super alloy NCF 751 (Ni-15.5Cr-0.9Nb-1.2A1-2.3Ti-7Fe-0.56C) are used.

The aforementioned Ni-based supper alloy is an alloy excellent not only in the high-temperature strength but also in the high-temperature oxidation resistance and the high-temperature corrosion resistance. Namely, although there is a problem of high-temperature corrosion caused by PbO and $PbSO_4$ produced on a surface of the valve as combustion products in a case of using leaded gasoline which is added with tetraethyl lead in order to increase the octane value, the high-temperature corrosion resistance is improved in this super alloy by increasing the amount of Ni up to 70 wt %.

However, this super alloy contains a great amount of expensive Ni as much as 70 wt % and there is a problem in the cost, accordingly an alloy containing the Ni amount reduced down to 60 wt % so as to cut the price and yet having the property equal to that of the aforementioned super alloy of NCF has been developed (cf. Japanese Patent Application No. 63-95731/88).

Lately, removal or reduction of tetraethyl lead from leaded gasoline is forwarded and the problem concerning the high-temperature corrosion becomes not so severe as compared with before, therefore it becomes clear that alloys are available sufficiently for engine valve without improving the high-temperature corrosion resistance so much. However, a demand of reduction in price and conservation of resources becomes further strict in mobile application materials as compared before, and the demand from a viewpoint of the reduction in price and the conservation of resources is further increasing also in the exhaust valve materials.

Therefore, an approach for decreasing the Ni content has been carried out within a limit of exhibiting sufficient practical utility in the corrosion resistance since it has been known that corrosion loss caused by the aforementioned PbO attack is closely connected with the Ni content, and decreases along with an increase of the Ni content. For example, alloys for exhaust valves containing Ni of 40 wt % have been already disclosed in Japanese Patent Application No. 54-93719/79, No. 59-130628 and so on.

However, in the aforementioned alloys, there is a problem in that η-phase ($Ni_3Ti$) which is a brittle phase is precipitated during the long time application at a high-temperature to reduce the high-temperature strength, therefore it is not possible necessarily to satisfy the aforementioned demand sufficiently.

Furthermore, the alloy are naturally required to be excellent not only in the corrosion resistance and the high-temperature strength, but also in the hot workability for manufacturing the engine valves and so on.

SUMMARY OF THE INVENTION

This invention is made in order to solve the aforementioned problems of the prior art, and it is an object to provide a heat resisting alloy which is possible to reduce the Ni content, and excellent in the structural stability (harmful η-phase and σ-phase are not precipitated by the long time application at a high-temperature) and the hot workability.

That is, the heat resisting alloy according to this invention for attaining the aforementioned object is characterized by consisting essentially by weight percentage of 0.01 to 0.10 % of C, not more than 2.0 % of Si, not more than 2.0% of Mn, 14 to 20% of Cr, 0.3 to1.5% Nb, 1.5 to3.5% of Ti, 0.5 to 1.5% of Al, 35 to 45% of Ni, 0.001 to 0.01% of B, at least one element selected from 0.001 to 0.03% of Ca and 0.001 to 0.03% of Mg, and the balance being Fe and inevitable impurities, wherein the total atomic percentage of Al, Ti and Nb is in a range of 4.5 to 6.0%, an atomic percentage ratio of Ti/Al is in a range of 1.0 to 2.0, and M value calculated using the following equation does not exceed 0.925;

M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction)+1.001 Mn (atomic fraction)+1.90 Si (atomic fraction).

In preferred embodiments according to this invention, Ti and Al may be limited to not more than 3.0% and 1.2%, respectively.

Furthermore, Ni and Nb may be fully or partially substituted by Co and Ta, respectively. In this case, the total atomic percentage of Al, Ti, Nb and Ta is limited in the range of 4.5 to 6.0%, and the M-value is calculated through an equation; M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction) +1.001 Mn (atomic fraction)+1.90 Si (atomic fraction)+0.777 Co (atomic fraction)+2.224 Ta (atomic fraction).

DETAILED DESCRIPTION OF THE INVENTION

According to the invention, the reason why the chemical compositions of the alloy is limited to the above-mentioned ranges will be described below.

C: 0.01 to 0.10 wt %

C combines with Ti, Nb or Cr to from a carbide and improves the high-temperature strength of the alloy. It is necessary to add C in an amount of at least 0.01 wt % in order to obtain such an effect. However, when a large amount of C is added, MC type-carbides are much precipitated so that the hot workability is deteriorated and defects develop on a surface of the valve from the carbides at the time of drawing the valve rod, therefore the upper limit of C is defined as 0.10 wt %.

Si: not more than 2.0 wt %

Si is added not only as a deoxidation element but also as an element effective for improving the oxidation resistance. However, excessive addition of Si causes deterioration of the ductility, so that the upper limit of Si is defined as 2.0 wt %.

Mn: not more than 2.0 wt %

Although Mn is added to the alloy as a deoxidation element similarly to Si, the high-temperature oxidation property is deteriorated and precipitation of η-phase ($Ni_3Ti$) harmful to the ductility of the alloy is promoted when Mn is added in large quantities. Accordingly the upper limit of Mn is defined as 2.0 wt %

Cr: 14 to 20 wt %

Cr is an element effective to improve the high-temperature oxidation resistance and the corrosion resistance. It is necessary to add Cr in an amount of not less than 14 wt % in order to maintain the sufficient high-temperature oxidation resistance and corrosion resistance, however the austenire phase becomes unstable, and the σ-phase and the α-phase (brittle phase) are precipitated, thereby degrading the ductility of the alloy when Cr is added in an amount of more than 20 wt %. Therefore, the upper limited of Cr is defined as 20 wt %.

Nb: 0.3 to 1.5 wt %

Nb is an element for forming γ'-phase {$Ni_3$ (Al, Ti, Nb, Ta)} which is a precipitation hardening phase for the Ni-based supper alloy, and effective not only for reinforcing the γ'-phase but also for preventing the coarsening of the γ'-phase. In order to obtain such effects, it is necessary to add Nb in an amount of at least 0.3 wt %, however δ-phase {$Ni_3$ (Nb, Ta)} is precipitated and brings about deterioration of the ductility when Nb is added excessively. Accordingly the upper limit of Nb is defined as 1.5 wt %.

Additionally, Ta also has the effect similar to that of Nb. Therefore, it is possible to replace Nb fully or partially with Ta in an embodiment of this invention.

Ti: 1.5 to 3.5 wt %

Ti is an element that combines with Ni to form the γ'-phase and strengthen the γ'-phase. By adding Ti, age-precipitation hardening of the γ'-phase is activated. It is necessary to add Ti in an amount of 1.5 wt % at the lowest in order to obtain such effects. However, the excessive addition of Ti brings about the precipitation of the η-phase (embrittle phase) to deteriorate the ductility of the alloy. Accordingly, the upper limit of the addition of Ti is defined as 3.5 wt %.

In a case of melting the alloy according to this invention in the atmosphere, Ti content is desirable to be low because Ti is an active metal and easy to form non-metallic inclusion. Therefore, Ti content is defined preferably in a range of 1.5 to 3.0 wt % in another embodiment of this invention.

Al: 0.5 to 1.5 wt %

Al is the most important element which combines with Ni to form the γ'-phase. Accordingly, it is necessary to add Al in an amount of at least 0.5 wt % because the γ'-phase is not precipitated sufficiently if the amount of Al added is too low, and the γ'-phase becomes unstable and the η-phase or the δ-phase is precipitated to cause the embrittlement when there are Ti, Nb and Ta in large quantities in the alloy. On the other side, the upper limit of Al is defined as 1.5 wt % since the hot workability of the alloy is degraded and the forming of the valve becomes impossible when the amount of Al is too large.

In the case of melting the alloy according to this invention in the atmosphere, Al content is desirable to be low because Al is an active metal and easy to form non-metallic inclusion. Therefore, Al content is defined preferably in a range of 0.5 to 1.2 wt % in the other embodiment of this invention.

Ni: 35 to 45 wt %

Ni is an element forming a matrix of the austenire and the element for improving the heat resistance and the corrosion resistance of the alloy. Furthermore, it is the element forming the γ'-phase being a precipitation reinforcement phase. In order to obtain such effects, Ni of not less than 35 wt % is required. However, Ni is very expensive element, so that the addition of Ni in large quantities raises the cost of the alloy, does not contribute to the conservation of resources and is unfit for the purpose of this invention. Consequently, the upper limit of Ni is defined as 45 wt %.

Additionally, Co also has the effect similar to that of Ni. Therefore, it is possible to replace Ni fully or partially with Co in the other embodiment of this invention. However, it is desirable to limit the Co content to less than 10 wt % since the γ'-phase becomes difficult to be precipitated if Co is added in an amount of not less than 10 wt % against the Ni content.

B: 0.001 to 0.01 wt %

B is an element effective for improving the hot workability in addition to improving the creep rupture strength by precipitating at the grain boundary, and it is necessary to add B in an amount of not less than 0.001 wt % in order to sufficiently develop such effects. However, excessive addition of B is harmful to the hot workability of the alloy, therefore the upper limit of B is defined as 0.001 wt %. One or both of Mg: 0.001 to 0.03 wt %, and Ca: 0.001 to 0.03 wt %

These elements are elements to be added as deoxidation and desulfurizing elements at the time of melting the alloy, Ca is effective to fix the residual sulfer by forming sulfides and improve the hot workability of the alloy. Mg improves the hot workability by precipitation at the grain boundary. Such effects of Ca and Mg are obtained when Ca and Mg are added in an amount of not less than 0.001 wt % respectively and the hot workability is deteriorated by the excessive addition, therefore the amounts of Ca and Mg are defined in ranges of 0.001 to 0.03 wt %, respectively.

Fe:balance

Fe being the balance of the alloy is an element forming the austenite phase, that is the matrix.

Total atomic percentage of Al+Ti+Nb+Ta: 4.5 to 6.0%

As mentioned above, Al, Ti, Nb and Ta are elements for forming the γ'-phase. Therefore, a volume ratio of precipitated γ'-phase is proportional to the total atomic percentage of these elements when the amount of Ni exists sufficiently. As the high-temperature strength is proportional to the volume ratio of the γ'-phase, the high-temperature strength of the alloy is improved in proportion to the total atomic percentage of these elements. On the other side, when the total atomic percentage of these elements exceeds 6.0 %, the strength is improved but the hot workability of the alloy is deteriorated, whereby the alloy becomes unfit for the purpose of this invention. Therefore, the upper limit of the total atomic percentage of these elements is defined as 6.05%. Contrary to this, if the total atomic percentage of these elements is reduced to less than 4.5%, the strength of the alloy is degraded, therefore the lower limit of the total atomic percentage is defined as 4.5%.

Atomic percentage ratio of Ti/Al: 1.0 to 2.0

The η-phase, that is an intermetallic compound precipitated during the application for a long time, deteriorates the mechanical properties of the alloy. The precipitation of the η-phase depends on the ratio of Ti to Al (Ti/Al) contained in the alloy. Accordingly, the ratio of Ti/Al is controlled so as not to precipitate the η-phase in this invention. Namely, in the alloy having the amount of Ni in 40 wt % level, the η-phase is precipitated when the ratio of Ti/Al is larger than 2.0 by atomic percentage. Therefore, the ratio of Ti/Al is limited to not larger than 2.0 by atomic percentage in this invention. However, If the ratio of Ti/Al becomes smaller than 1.0, the age-hardening rate becomes slow and difficult to obtain the sufficient strength by aging in a short time, therefore the ratio of Ti/Al is limited to not smaller than 1.0 by atomic percentage.

M-value: not exceeding 0.925

M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction)+1.001 Mn (atomic fraction)+1.90 Si (atomic fraction)+0.777 Co (atomic fraction) +2.224 Ta (atomic fraction)

The σ-phase, that is an intermetallic compound precipitated during the application for a long time, deteriorates the mechanical properties of the alloy. With reference to the σ-phase, it has been made clear according to this investigation that the σ-phase is precipitated when the M-value calculated using the aforementioned equation becomes larger than 0.925. Furthermore, it has been also made clear that the M-value has concern also with the hot workability of the alloy and the workability is deteriorated if the M-value becomes larger than 0.925. Accordingly, the M-value is controlled so as not to exceed 0.925.

The inventors have developed the new alloy in order to solve the aforementioned problems from viewpoints (1) to (3) as follows.

(1) High-temperature strength

Conventionally, the high-temperature strength of Ni-based supper alloy was improved by precipitating the γ'-phase {$Ni_3$ (Al, Ti)} which has reverse-temperature dependency to the strength, the high-temperature strength of the alloy becomes higher according as an amount of the precipitated γ'phase increases, that is according as the amounts of Al, Ti, Nb and Ta added which are precipitation reinforcing elements of the γ'-phase in the alloy increases. However, when the γ'-phase is precipitated in large quantities, there is inconvenience in that roll-blooming becomes impossible, and it becomes impossible to process the materials by rolling. It has been confirmed through the investigation that the hot workability is deteriorated when the total amount of added Al, Ti, Nb, and Ta exceeds 6.0% by atomic percentage. Therefore, the high-temperature strength and the hot workability are secured by defining the upper limit of the total atomic percentage of Al, Ti, Nb and Ta, which are the γ'-phase forming elements, as 6.0% in the alloy according to this invention. On the other side, there is a problem in that the high-temperature strength is degraded when the total atomic percentage of Al, Ti, Nb and Ta is too small. Accordingly, it is necessary to limit the total atomic percentage of Al, Ti, bib and Ta to not less than 4.5% in order to attain the object of this invention. (2) Phase stability The η-phase and the σ-phase, which are intermetallic compounds precipitated during the application for a long time, deteriorates the mechanical properties of the alloy. Accordingly, a countermeasure is devised in this invention so as not to precipitate such the precipitation after the application for a long time.

It has been made clear through the investigation that the precipitation of the ηphase depends on the ratio of Ti to Al (Ti/Al) contained in the alloy. Namely, the η-phase is precipitated in the alloy containing Ni in the level of 40% when the ratio of Ti/Al is larger than 2.0 by atomic percentage. Therefore, the ratio of Ti/Al is limited to not larger than 2.0 by atomic percentage in this invention. However, when the ratio of Ti/Al becomes smaller than 1.0, the age-hardening speed becomes slow and difficult to obtain the sufficient strength by aging in a short time, therefore the ratio of Ti/Al is limited to not smaller than 1.0 by atomic percentage.

Next, concerning the σ-phase, it has been made clear through the investigation that the σ-phase is precipitated when the M-value obtained according to the following equation becomes larger than 0.925, and the M-value is controlled so as not to exceed 0.925. Furthermore, it has been also made clear that the M-value is related to the hot workability of the alloy, which is deteriorated if the M-value becomes larger than 0.925.

M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction)+1.001 Mn (atomic fraction)+1.90 Si (atomic fraction)+0.777 Co (atomic fraction) +2.224 Ta (atomic fraction) (3) Hot workability As mentioned above, in order to project to reduce the price of the engine valve as an object of this invention, it is difficult to attain the object sufficiently by merely using inexpensive alloying elements. Namely, it is required that it is possible to process the alloy by roll-blooming as a manufacturing method low in the cost, but by forge-blooming which is high in the manufacturing cost. Accordingly, in this invention, the workability of the alloy is maintained in an excellent range by defining the upper limit of the M-value at the same time of putting bounds to the maximum value of the total atomic percentage of Al, Ti, Nb and Ta which is closely concerned with the workability of the alloy. Furthermore, the hot workability is improved by adding Mg and Ca, which are elements effective for improving the hot workability of the alloy.

That is, the alloy according to this invention is found as a result of repeating studies from the aforementioned viewpoints of (1) high-temperature strength, (2) phase stability, and (3) hot workability, the heat resisting alloy which is possible to reduce the amount of Ni and excellent in the structural stability - namely, the harmful η-phase and the σphase are not precipitated during the application at a high temperature for a long time -, and excellent in the hot workability by controlling the chemical composition of the alloy, the total atomic percentage of Al, Ti, Nb and Ta, the atomic percentage ratio of Ti/Al and the M-value in the aforementioned claimed ranges, respectively.

EXAMPLE

Next, suitable examples will be explained below together with comparative examples in order to make clear the effect of this invention.

Alloys of 11 kinds belonging to examples according to this invention (hereinafter, called as invention alloys) and alloys of 7 kinds of comparative examples (hereinafter, called as comparative alloys) shown in the following Table 1 were melted in a vacuum induction furnace respectively, and then cast into respective ingots of 30 kg. Subsequently, casting surfaces of the respective ingots are peeled after subjecting the ingots to soaking treatment at 1160° C. for 16 hours.

TABLE 1

| Alloy No. | | Chemical composition (wt %) C | Ni | Co | Cr | Nb | Ti | Al | Fe | B | Mg | Ca | M | Al + Ti + Nb + Ta (at %) | Ti/Al (at %) |
|---|---|---|---|---|---|---|---|---|---|---|---|---|---|---|---|
| Invention alloy | 1 | 0.05 | 42.0 | — | 15.9 | 0.81 | 2.46 | 0.72 | 38.1 | 0.003 | 0.007 | — | 0.910 | 4.84 | 1.925 |
| | 2 | 0.05 | 142.0 | — | 16.1 | 0.81 | 2.79 | 0.86 | 37.4 | 0.003 | 0.005 | — | 0.919 | 5.50 | 1.827 |
| | 3 | 0.05 | 42.3 | — | 16.1 | 0.82 | 2.91 | 0.91 | 36.9 | 0.003 | 0.006 | — | 0.922 | 5.74 | 1.801 |
| | 4 | 0.05 | 44.0 | — | 19.1 | 0.70 | 2.52 | 0.79 | 32.8 | 0.006 | 0.004 | — | 0.919 | 4.97 | 1.797 |
| | 5 | 0.05 | 44.5 | — | 15.5 | 0.55 | 2.30 | 1.20 | 35.9 | 0.007 | 0.005 | — | 0.911 | 5.46 | 1.080 |
| | 6 | 0.05 | 40.1 | — | 14.4 | 0.80 | 2.40 | 1.30 | 40.9 | 0.005 | — | 0.005 | 0.919 | 5.92 | 1.040 |
| | 7 | 0.05 | 39.8 | — | 14.2 | 0.56 | 3.10 | 0.92 | 41.4 | 0.005 | — | 0.003 | 0.920 | 5.82 | 1.898 |
| | 8 | 0.02 | 36.6 | — | 14.2 | 1.32 | 2.50 | 0.80 | 44.6 | 0.007 | — | 0.006 | 0.919 | 5.36 | 1.760 |
| | 9 | 0.04 | 36.4 | — | 17.1 | 0.71 | 2.45 | 0.85 | 42.4 | 0.004 | 0.004 | 0.002 | 0.923 | 5.01 | 1.624 |
| | 10 | 0.05 | 42.0 | — | 15.6 | 0.95 | 2.55 | 1.05 | 37.8 | 0.005 | 0.004 | 0.003 | 0.919 | 5.69 | 1.368 |
| | 11 | 0.05 | 41.0 | 4.5 | 16.0 | 0.81 | 2.65 | 0.85 | 34.1 | 0.003 | 0.005 | — | 0.914 | 5.33 | 1.756 |
| Comparative alloy | 12 | 0.05 | 42.2 | — | 15.8 | 0.79 | 2.10 | 0.65 | 38.4 | 0.003 | 0.005 | — | 0.902 | 4.27 | 1.820 |
| | 13 | 0.05 | 44.5 | — | 14.5 | 1.20 | 3.10 | 1.10 | 35.5 | 0.002 | 0.003 | — | 0.924 | 6.59 | 1.587 |
| | 14 | 0.05 | 42.3 | — | 15.5 | 0.80 | 3.08 | 0.70 | 37.6 | 0.003 | 0.004 | — | 0.918 | 5.51 | 2.478 |
| | 16 | 0.12 | 38.2 | — | 19.5 | 0.90 | 2.81 | 0.98 | 37.5 | 0.005 | 0.005 | — | 0.935 | 5.78 | 1.615 |
| | 17 | 0.03 | 41.9 | — | 19.2 | 0.93 | 3.01 | 1.15 | 33.8 | 0.005 | 0.005 | — | 0.940 | 6.39 | 1.474 |
| | 18 | 0.04 | 41.3 | — | 16.3 | 1.18 | 2.75 | 0.9 | 37.4 | 0.004 | — | — | 0.924 | 5.76 | 1.721 |

Note
The amount of each of Si and Mn is in the range of 0.1 to 0.5 wt %.
M = 0.717 Ni + 0.585 Fe + 1.142 Cr + 1.90 Al + 2.271 Ti + 2.117 Nb + 1.001 Mn + 1.90 Si + 0.777 Co + 2.224 Ta (atomic fraction)

Then a round bar specimen of 8mm in diameter was cut out from each of soaking-treated alloy ingots and the high temperature—high speed tensile test was carried out using the round bar specimen under an elastic stress rate of 50mm/s at a temperature of 800 to 1250° C. In the following Table 2, a temperature range possible to obtain reduction of area of not less than 60%, which is required for the roll working, is shown as a hot-workable temperature range on basis of the result of the aforementioned high temperature-high speed tensile test concerning the respective invention alloys and the comparative alloys.

The remaining alloy ingot was subjected to forging and rolling at the temperature range of 1160° to 900° C. to form a round bar of 16 mm in diameter. The obtained round bar was subjected to solid solution heat treatment (heating at 1050° C. for 30 min - oil cooling) and aging heat treatment (heating at 750° C. for 4 hours air-cooling), then the hardness test and the high-temperature tensile test at 800° C. were carried out using the aging-treated round bar. Furthermore, the aforementioned aging-treated round bar was subjected to overaging heat treatment at 800° C for 400 hours, and then the rotary bending fatigue test was curried out at 800°C. using the overaging-treated round bar. Obtained results are shown in Table 2 together with the aforementioned results.

TABLE 2

| Alloy No. | | Aging heat treatment (750° C. × 4 hr – AC) Hardness (HRC) | Tensile Strength (MPa) | Elongation (%) | Overaging heat treatment (800° C. × 400 hr – AC) Fatigue Strength (MPa) | η-phase | Hot-workable temperature range (°C.) |
|---|---|---|---|---|---|---|---|
| Invention alloy | 1 | 34.0 | 572 | 11.0 | 17.5 | None | 282 |
| | 2 | 35.0 | 619 | 7.4 | 18.5 | None | 265 |
| | 3 | 34.2 | 636 | 6.0 | 18.9 | None | 232 |
| | 4 | 33.3 | 582 | 10.3 | 17.7 | None | 272 |
| | 5 | 33.8 | 617 | 7.6 | 18.5 | None | 259 |
| | 6 | 35.1 | 649 | 5.0 | 19.2 | None | 223 |
| | 7 | 36.2 | 642 | 5.6 | 19.1 | None | 216 |
| | 8 | 34.0 | 609 | 8.1 | 18.3 | None | 269 |
| | 9 | 34.1 | 585 | 10.1 | 17.7 | None | 273 |
| | 10 | 34.5 | 633 | 6.3 | 18.8 | None | 251 |
| | 11 | 33.5 | 615 | 9.3 | 18.1 | None | 231 |
| | 12 | 32.1 | 532 | 14.1 | 16.5 | None | 293 |
| Comparative alloy | 13 | 35.9 | 696 | 4.7 | 20.3 | None | 188 |
| | 14 | 36.1 | 620 | 3.3 | 16.2 | Formed | 253 |
| | 15 | 28.3 | 521 | 18.5 | 18.7 | None | 274 |
| | 16 | 34.7 | 639 | 5.8 | 19.0 | None | 183 |
| | 17 | 35.3 | 682 | 2.4 | 20.0 | None | 141 |
| | 18 | 34.2 | 636 | 5.3 | 18.7 | None | 193 |

(1) Results of high temperature-high speed tensile test

As is apparent from Table 2, the invention alloys No.1 to 11 had hot-workable temperature ranges wider than 200° C. and were suitable to alloys for exhaust valves, for example.

Contrary to above, in the comparative alloy No.13 contained with Al, Ti, Nb and Ta more than 6.0% by the total atomic percentage, the γ'-phase was precipitated in large quantities, the hot-workable temperature range was restricted as small as 188° C. and forging cracks developed partially at the time of forging. In the comparative alloy No. 17 which was too large in the total atomic percentage of Al, Ti, Nb and Ta, and the M-value, it was impossible to roll because of cracks developed at the forging, therefore properties of the alloy was evaluated by using the rest body of the forging. Furthermore, also in the comparative alloy No.18 which was not added with Mg or Ca effective for improving the hot workability, the hot-workable temperature range was restricted as small as 193° C. and cracks developed partially at the time of rolling. The comparative alloys No.12, 14 and 15 had suitable hot-working temperature range wider than 200° C., however they were not suitable in the other properties as described below.

(2) Result of hardness at room temperature, high-temperature tensile test and rotary bending fatigue test As is evident from Table 2, the invention alloys No.1 to 11 were hardened sufficiently by aging and excellent in the tensile strength, accordingly were suitable to alloys for exhaust values or the like as a heat resisting alloy because the η-phase was not formed even after the aging heat treatment for a long time and the fatigue strength was in high level.

On the other side, the comparative alloy No.15 was not hardened sufficiently and not so excellent in the hardness as low as HRC 28.3 even by the aging treatment at 750° C. for 4 hours - air cooling, and not so high in the tensile strength as compared with the invention alloys No.1 to 11 since the atomic percentage ratio of Ti/Al was lower than 1.0. In the comparative alloy No.12, the γ'-phase was not precipitated sufficiently, and the hardness, the tensile strength and the fatigue strength were low as compared with the invention alloys No.1 to 11 because the total atomic percentage of Al, Ti, Nb and Ta was lower than 4.5%. Furthermore, in the comparative alloy No.14, The η-phase was formed in large quantities after aging treatment for a long time and the fatigue strength was degraded since the atomic percentage ratio of Ti/Al was higher than 2.0.

Although the present invention has been described concerning the preferred examples, this invention is not limited to the above-mentioned examples, it is possible to practice the invention in various forms without departing from the sprit and scope of this invention.

As mentioned above, according to this invention, it is possible to reduce the amount of Ni down to 40% level and to realize the reduction in price and the conservation of resources, and possible to obtain the supper alloy excellent in the high-temperature strength and the hot workability, further in the structural stability, that is the harmful η-phase and σ-phase are never precipitated even after the application at a high-temperature for a long time. Consequently, the alloy according to this invention is applicable to exhaust values of engines or the like very effectively as a heat resisting alloy.

What is claimed is:

1. A heat resisting alloy consisting essentially by weight percentage of 0.01 to 0.10% of C, not more than 2.0 % of Si, not more than 2.0% of Mn, 14 to 20% of Cr, 0.3 to 1.5% of Nb, 1.5 to 3.5% of Ti, 0.5 to 1.5% of Al, 35 to 45% of Ni, 0.001 to 0.0196% of B, at least one element selected from 0.001 to 0.03% of Ca and 0.001 to 0.03% of Mg, and the balance being Fe and inevitable impurities, wherein the total atomic percentage of Al, Ti and Nb is in a range of 4.5 to 6.0% an atomic percentage ratio of Ti/Al is in a range of 1.0 to 2.0, and M-value calculated using the following equation does not exceed 0. 925;

M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction)+1.001 Mn (atomic fraction)+1.90 Si (atomic fraction).

2. A heat resisting alloy according to claim 1, wherein the weight percentage of Ti does not exceed 3.0%.

3. A heat resisting alloy according to claim 1, wherein the weight percentage of Al does not exceed 1.2%.

4. A heat resisting alloy according to claim 2, wherein the weight percentage of Al does not exceed 1.2%.

5. A heat resisting alloy according to claim 1, wherein the amount of Ni is fully or partially substituted by Co, provided that said M-value is calculated using an equation; M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction)+1.001 Mn (atomic fraction) 1.90 Si (atomic fraction)+0.777 Co (atomic fraction).

6. A heat resisting alloy according to claim 2, wherein the amount of Ni is fully or partially substituted by Co, provided that said M-value is calculated using an equation; M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction)+1.001 Mn (atomic fraction) +1.90 Si (atomic fraction)+0.777 Co (atomic fraction).

7. A heat resisting alloy according to claim 3, wherein the amount of Ni is fully or partially substituted by Co, provided that said M-value is calculated using an equation; M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction)+1.001Mn (atomic fraction) 1.90 Si (atomic fraction)+0.777 Co (atomic fraction).

8. A heat resisting alloy according to claim 4, wherein the amount of Ni is fully or partially substituted by Co, provided that said M-value is calculated using an equation; M=0.717 Ni (atomic fraction)+0.858 Fe (atomic fraction)+1.142 Cr (atomic fraction)+1.90 Al (atomic fraction)+2,271 Ti (atomic fraction)+2.117 Nb (atomic fraction)+1.001Mn (atomic fraction) 1.90 Si (atomic fraction)+0.777 Co (atomic fraction).

9. A heat resisting alloy according to claim 1, wherein the amount of Nb is fully or partially substituted by Ta, provided that the total atomic percentage of Al, Ti, Nb and Ta is in the range of 4.5 to 6.0% and said M-value is calculated using an equation; M=0.717 Ni (atomic fraction)+0.858 Fe (atomic fraction)+1,142 Cr (atomic fraction)+1.90 Al (atomic fraction)+2.271 Ti (atomic fraction)+2.117 Nb (atomic fraction)+1. 001 Mn (atomic fraction) +1.90 Si (atomic fraction)+2.224 Ta (atomic fraction).

10. A heat resisting alloy according to claim 2, wherein the amount of Nb is fully or partially substituted by Ta, provided that the total atomic percentage of Al, Ti, Nb and Ta is in the range of 4.5 to 6.0% and said M-value is calculated using an equation; M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction)+1.001 Mn (atomic fraction) 1.90 Si (atomic fraction)+2.224 Ta (atomic fraction).

11. A heat resisting alloy according to claim 3, wherein the amount of Nb is fully or partially substituted by Ta, provided that the total atomic percentage is in the range of 4.5 to 6.0% and said M-value is calculated using an equation; M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction) 1.001 Mn (atomic fraction)+1.90 Si (atomic fraction)+2.224 Ta (atomic fraction).

12. A heat resisting alloy according to claim 4, wherein the amount of Nb is fully or partially substituted by Ta, provided that the total atomic percentage of Al, Ti, Nb and Ta is in the range of 4.5 to 6.0% and said M-value is calculated using an equation ; M=0.717 Ni (atomic fraction)+0.858 Fe (atomic fraction)+1.142 Cr (atomic fraction)+1.90 Al (atomic fraction)+2. 271 Ti (atomic fraction)+2.117 Nb (atomic fraction)+1.001 Mn (atomic fraction) +1.90 Si (atomic fraction)+2.224 Ta (atomic fraction).

13. A heat resisting alloy according to claim 5, wherein the amount of Nb is fully or partially substituted by Ta, provided that the total atomic percentage of Al, Ti, Nb and Ta is in the range of 4.5 to 6.0% and said M-value is calculated using on aquation; M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction)+1.001 Mn (atomic fraction) +1.90 Si (atomic fraction)+0.777 Co (atomic fraction)+2.224 Ta (atomic fraction).

14. A heat resisting alloy according to claim 6, wherein the amount of Nb is fully or partially substituted by Ta, provided that the total atomic percentage of Al, Ti, Nb and Ta is in the range of 4.5 to 6.0% and said M-value is calculated using on aquation; M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction)+1.001 Mn (atomic fraction) +1.90 Si (atomic fraction)+0.777 Co (atomic fraction)+2.224 Ta (atomic fraction).

15. A heat resisting alloy according to claim 7, wherein the amount of Nb is fully or partially substituted by Ta, provided that the total atomic percentage of Al, Ti, Nb and Ta is in the range of 4.5 to 6.0% and said M-value is calculated using on aquation; M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction)+1.001 Mn (atomic fraction) +1.90 Si (atomic fraction)+0.777 Co (atomic fraction)+2.224 Ta (atomic fraction).

16. A heat resisting alloy according to claim 8, wherein the amount of Nb is fully or partially substituted by Ta, provided that the total atomic percentage of Al, Ti, Nb, and Ta is in the range of 4.5 to 6.0% and said M-value is calculated using on aquation; M=0.717 Ni (atomic fraction)+0.858 Fe (atomic fraction)+1.142 Cr (atomic fraction)+1.90 Al (atomic fraction)+2.271 Ti (atomic fraction)+2.117 Nb (atomic fraction)+1.001 Mn (atomic fraction) +1.90 Si (atomic fraction)+0.777 Co (atomic fraction)+2.224 Ta (atomic fraction).

* * * * *